US005182603A

United States Patent [19]

Yamada

[11] Patent Number: 5,182,603

[45] Date of Patent: Jan. 26, 1993

[54] SEPARATION CHARGER CONTROL FOR ELECTRO-PHOTOGRAPHIC APPARATUS

[75] Inventor: Takanobu Yamada, Toyokawa, Japan

[73] Assignee: Minolta Camera Kabushiki Kaisha, Osaka, Japan

[21] Appl. No.: 697,984

[22] Filed: May 10, 1991

[30] Foreign Application Priority Data

May 15, 1990 [JP] Japan ..... 2-125826

[51] Int. Cl.[5] ..... G03G 15/14

[52] U.S. Cl. ..... 355/273; 355/208; 355/315; 355/326; 361/214

[58] Field of Search ..... 355/273, 271, 272, 274, 355/326, 315, 208; 361/214, 235

[56] References Cited

U.S. PATENT DOCUMENTS

| | | | |
|---|---|---|---|
| 3,729,311 | 4/1973 | Langdon | 355/274 X |
| 3,877,416 | 4/1975 | Donohue et al. | 355/273 X |
| 4,134,147 | 1/1979 | Watanabe | 361/235 |
| 4,162,843 | 7/1979 | Inoue et al. | 355/274 X |
| 4,676,627 | 6/1987 | Ohno | 355/326 X |
| 4,771,318 | 9/1988 | Noguchi et al. | 355/315 |
| 4,816,871 | 3/1989 | Oushiden et al. | 355/208 |
| 4,912,515 | 3/1990 | Amemiya et al. | 355/274 |

FOREIGN PATENT DOCUMENTS

| | | |
|---|---|---|
| 62-191863 | 8/1987 | Japan . |
| 64-43367 | 3/1989 | Japan . |

*Primary Examiner*—A. T. Grimley
*Assistant Examiner*—Nestor R. Ramirez
*Attorney, Agent, or Firm*—Burns, Doane, Swecker & Mathis

[57] ABSTRACT

A separation charger is acts on a transfer sheet after an image is transferred onto the sheet for a predetermined number of times at an ouput corresponding to the number of times the image is transferred onto the transfer sheet of a transfer drum. An image forming apparatus forms a high quality image by correcting the ouput of the transfer charger and seperation charger based on the humidity and type of copy sheet detected.

9 Claims, 5 Drawing Sheets

TRANSFER CHARGER OUTPUT SETTING
(BLOCK 1)
FIRST ROUND ROTATION OUTPUT?
N
Y
200 μA SET
SECOND ROUND ROTATION OUTPUT?
N
Y
300 μA SET
THIRD ROUND ROTATION OUTPUT?
N
Y
400 μA SET
500 μA SET
(BLOCK 2)
DETECTED HUMIDITY READING
OVER 80% ?
N
Y
SETTING VALUE - 100 μA
79 - 70 ?
N
Y
SETTING VALUE - 50 μA
69 - 50 ?
N
Y
SETTING VALUE
50 - 35 ?
N
Y
SETTING VALUE + 50 μA
SETTING VALUE + 100 μA
(BLOCK 3)
O H P ?
N
Y
RESETTING VALUE + 100 μA
RETURN

SEPARATION CHARGER OUTPUT SETTING
(BLOCK 11)
TRANSFER MODE ONE TIME ?
N
Y
2KV SET
TRANSFER MODE TWO TIMES ?
N
Y
3KV SET
TRANSFER MODE THREE TIMES ?
N
Y
4KV SET
5KV SET
(BLOCK 12)
DETECTED HUMIDITY READING
OVER 80% ?
N
Y
SETTING VALUE - 1 KV
79 - 70 ?
N
Y
SETTING VALUE - 0.5 KV
69 - 50 ?
N
Y
SETTING VALUE
50 - 35 ?
N
Y
SETTING VALUE + 0.5 KV
SETTING VALUE + 1 KV
(BLOCK 13)
O H P ?
N
Y
RESETTING VALUE + 1 KV
RETURN

SEPARATION CHARGER CONTROL FOR ELECTRO-PHOTOGRAPHIC APPARATUS

BACKGROUND OF THE INVENTION

1. Technical Field of the Invention

The present invention relates to an image forming apparatus, and more particularly, to an image forming apparatus which is capable of repeatedly transferring an image formed on an image holding member onto a transfer sheet held on a transfer material holding member and is provided with a separation charger for activating a part of the transfer material holding member where the transfer sheet is separated after the completion of a transfer process.

2. Description of Related Art

An image forming apparatus of this kind is disclosed, for instance, in Japanese Published Unexamined Patent Application TOKKAI SHO 62-191863. A transfer material holding member is arranged to electrostatically hold a transfer sheet, and a dielectric is utilized therein. When a transfer sheet is separated from the transfer holding member after the completion of a transfer process, an aerial discharge is generated at a location where the transfer sheet is separated. The aerial discharge causes to scatter the toner of the image transferred onto the transfer sheet therefrom, and eventually, the transferred image falls into disorder.

In order to avoid such a problem, it has heretofore been arranged to actuate a separation charger on a part of the transfer material holding member where a transfer sheet is separated after the completion of a transfer process. The separation charger removes electric charge of the transfer material holding member by neutralizing the charge, for instance, by alternating corona discharge. The aerial discharge is thereby decreased to prevent the toner from dispersion.

Electric charge to be charged on the transfer material holding member varies according to the number of times an image is transferred onto a transfer sheet. For instance, even if a transfer process is simply repeated, the charge on the transfer material holding member is risen every time the transfer process is repeated.

In the known art disclosed in said publication, when an output of the transfer charger is raised every time transfer process is repeated, the electric charge to be charged is remarkably risen. However, since an output of the separation charger is set at a constant value, it happens that the electric charge is excessively or insufficiently removed according to the number of times of transfer processes.

For example, when a color image is formed by a four-color composite image forming process, the transfer material holding member is supposed to hold a transfer sheet after the completion of transfer process of a fourth color. If an output of the separation charger is set corresponding to an electric charge to be charged, the output exceeds the electric charge which is possessed by a transfer sheet and the transfer material holding member when an image is formed under three rounds of composite image forming processes. Under the circumstance, the charge of the transfer sheet is excessively removed when it is separated from the transfer material holding member by the separation charger. If the charge is excessively removed, the electrostatic adsorption force of toner to the transfer sheet is lowered.

The toner of an image transferred onto a transfer sheet tends to be scattered and causes to disorder the transferred image if the electrostatic adsorption force of the toner is lowered since the toner is affected by a mechanical shock when the transfer sheet runs into a pair of fixing rollers of a fixing device, by the electrostatic repulsive force generated by frictional charge between the fixing rollers, by the electrostatic repulsive force generated by frictional charge between the transfer sheet and a separation claw which is provided for mechanically separating the transfer sheet from the transfer material holding member, and the like.

Conversely, if an output is set corresponding to an electric charge to be possessed by a transfer material holding member after the completion of a first color transfer process, the output is insufficient for an electric charge to be possessed by the transfer material holding member when an image is formed by more than two rounds of composite image forming processes. The removal of charge can not therefore be made sufficiently when the transfer sheet is separated.

If the removal of charge can not be made sufficiently, aerial discharge is increased when a transfer sheet is separated from the transfer material holding member, and toner dispersion can not be prevented. Further, when the removal of charge is not made sufficiently, a separation claw forcibly separate a transfer sheet from the transfer material holding member to increase frictional charge between the transfer sheet since the electrostatic adsorption force of the transfer sheet and transfer material holding member is kept strong, and eventually, toner is scattered since the charge to be charged acts as an electrostatic repulsive force to the toner.

SUMMARY OF THE INVENTION

A primary object of the present invention is to provide an image forming apparatus which is capable of solving the above-described conventional problems by simple improvement wherein an output of a separation charger is set corresponding to the number of times of transfer process when an image forming operation is performed.

Another object of the present invention is to provide an image forming apparatus which is capable of forming a high quality image in the more stabilized state by correcting the output of a transfer charger and separation charger corresponding to the humidity and kind of copy sheet.

These and other objects and features of the present invention will become more apparent from the following description taken in conjunction with the accompanying drawings which illustrate specific embodiments of the invention.

DESCRIPTION OF THE PREFERRED EMBODIMENT

An embodiment of the present invention will now be described hereinafter referring to accompanying drawings.

Figure 1:
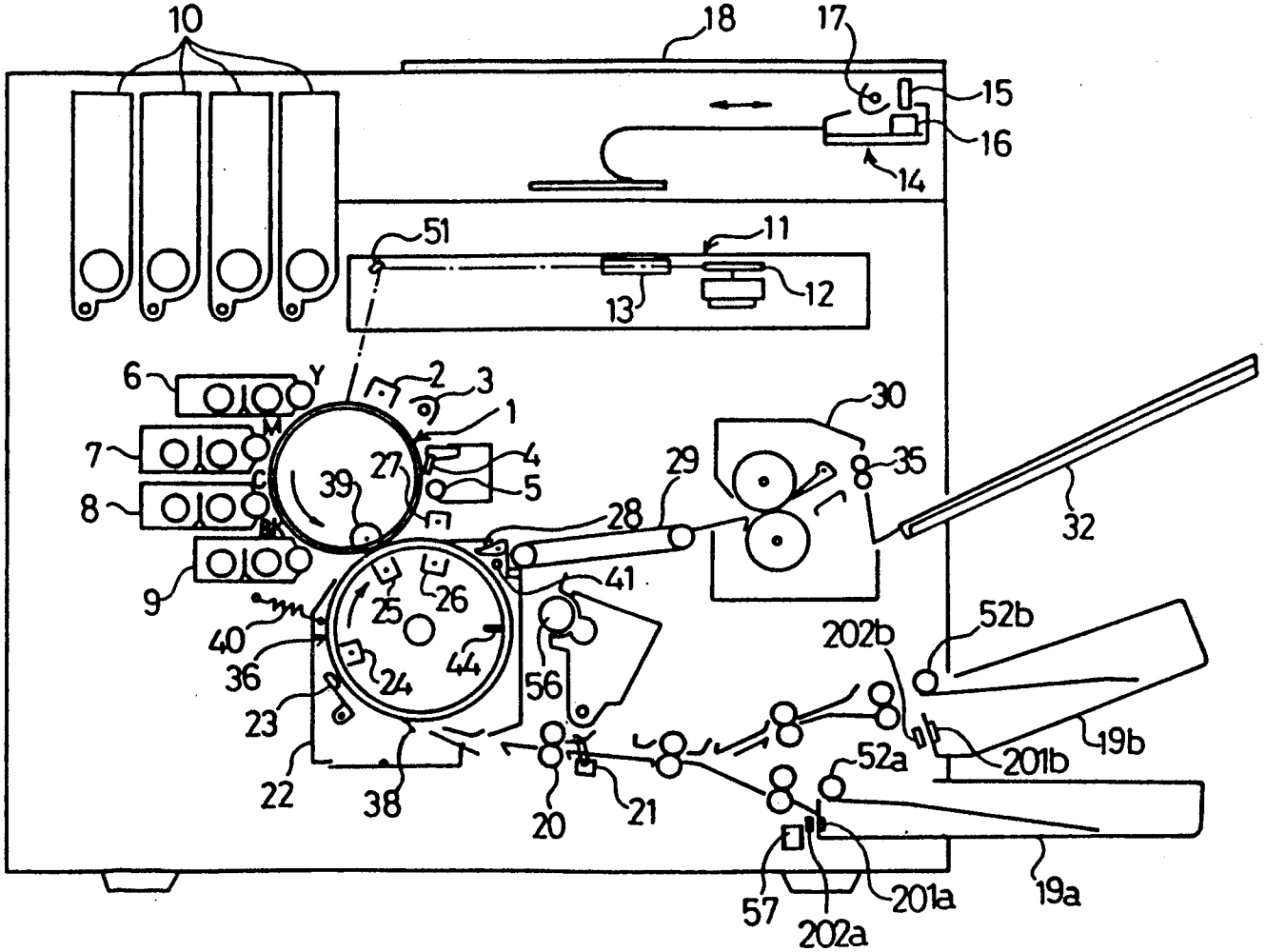
FIG. 1 is a cross sectional view showing a color copying machine to which the present invention is applied as an embodiment.

FIG. 1 shows a color copying machine to which the present invention is applied. In FIG. 1, an original placed on an original glass table 18 is exposed to a CCD line sensor 16 by an exposure lamp 17 and convergent optical lens array 15 which constitute an image reader unit and act as scanner, and is read as three primary color signals of R (red), G (green) and B (blue). The color signals of R, G and B are converted into three color signals of Y (yellow), M (magenta), C (cyan) or into four color signals with Bk (black) added to said three colors by an image processing circuit, and at the same time, they are supplied to a laser optical system 11 as output signals. The copying machine in the present embodiment is not provided with an image memory for three colors. The image reader unit 14 therefore performs scanning operations when each color image is formed, basing on which signals of Y, M, C or Y, M, C, Bk are supplied to the laser optical system 11.

The laser optical system 11 is provided with a polygon mirror 12 for scanning operation, $f\theta$ lens 13, reflective mirror 51 and the like, and irradiates laser light for image forming operations on each color based on said Y, M and C or Y, M, C and Bk to a photoconductive drum 1 for exposure process.

The photoconductive drum 1 is rotatively driven in the direction of an arrow. The surface of the photoconductive drum 1 is provided with an organic photoconductive member wherein an electric charge generating layer and an electric charge transporting layer are laid one another on the base plate of a conductor. Particularly, a photoconductive member which shows high sensitivity in the vicinity of laser emitting wave length of 780 nm is utilized. In the present embodiment, the photoconductor is negatively charged by a charger 2.

An image forming system of the apparatus in this embodiment is an N-P system wherein a positive image is obtained from a negative image. More particularly, an image is exposed to the photoconductive drum 1 by a laser light, and an electrostatic latent image thereby formed is developed with a negatively charged toner.

Around the photoconductive drum 1, there are disposed a drum cleaner 4, toner collecting roll 5, eraser lamp 3 and the charger 2 with four kinds of developing units. A first developing unit 6 supplies yellow toner, a second developing unit 7 magenta toner, a third developing unit 8 cyan toner and a fourth developing unit 9 black toner for said developing operations. The toner of each color separately accommodated in respective toner hoppers 10 is properly replenished to each one of the developing units 6, 7, 8, 9 by unillustrated transporting pipes in response to replenishing signal.

Transfer sheets of an ordinary sheet of paper or a film used for overhead projectors (hereinafter called as OHP) and the like are stacked and accommodated in paper feed cassettes 19*a* and 19*b*, and are fed one sheet by one sheet into the apparatus by paper feed rollers 52*a* and 52*b*.

In each one of the paper feed cassettes 19*a* and 19*b*, there is provided magnet 201*a*, 201*b* combined with a plurality of magnets which are utilized as codes to show the size and kind of material of the sheets accommodated therein. The magnets 201*a* and 201*b* are detected by sheet sensors 202*a* and 202*b* provided at the locations where the paper cassettes are mounted and detached, and the size and kind of material of transfer sheet being fed are judged by detecting signals. The operation of the apparatus can thus be controlled corresponding to the size and kind of material of transfer sheet. For judging the size and kind of material of transfer sheet, other appropriate means may also be adopted.

The leading end of a transfer sheet comes in contact with a timing roller 20 being stopped and forms a loop to correct the skew of the sheet, and at the same time, the following paper feeding timing is controlled by the drive starting timing of the timing roller 20. A reference numeral 21 represents a paper sensor provided for this purpose.

Between the timing roller 20 and photoconductive drum 1, there is arranged a transfer member or drum 36. The transfer drum 36 is rotatively driven in the direction of an arrow, and performs to transfer an image sent from the photoconductive drum 1 by holding a transfer sheet transported through the timing roller 20.

The transfer drum 36 is constructed with a cylindrical dielectric screen held in the frame of the drum, and is provided with a plurality of tip chucking claws 38 on the portions where both ends of the dielectric screen are fixed. The tip chucking claw 38 chucks the leading end of the transfer sheet transported by the timing roller 20 on the surface of the dielectric screen. Each one of the tip chucking claws 38 is properly opened and closed corresponding to the timing of feeding and completion of transfer process of the transfer sheet by an action of an unillustrated cam provided in the transfer drum 36.

Polyester net of 50 meshes is utilized for the dielectric screen, and its opening rate is approximately 30–70%. In place of the polyester net, nylon net may be utilized, and the dielectric screen may be constructed with a film such as polyester film in the thickness of approximately 70–120 μm.

As illustrated in FIG. 1, a frame 22 which supports the transfer drum 36 is rotatably held by the main body of the apparatus centering around an axis 41, and is energized by a spring 40 in the clockwise direction to be pressed in contact with a positioning roller 39 provided on the side of the photoconductive drum 1 to keep the photoconductive drum 1 and the transfer drum 36 at a fixed space of approximately 0.05–0.70 mm.

Only the tip portion of the transfer sheet forwarded to the transfer drum 36 through the timing roller 20 is held by the chucking claw 38, and is thereafter charged by a negatively charged adsorption charger 24 which is inside the transfer drum 36, and at the same time, an earth electrode 23 comes in contact with the surface of the transfer sheet to charge the dielectric film. By electrically grounding the surface of the transfer sheet, the transfer sheet is electrostatically adsorbed to the dielectric screen to be held by the transfer drum 36.

Then, a toner image on the photoconductive drum 1 which has been developed by a first color of yellow developing unit 6 is transferred onto a transfer sheet held on the transfer drum 36 by a transfer charger 25 from the surface of the photoconductive drum 1. At this stage, the developing units 7–9 other than the yellow developing unit 6 are kept under a state of non-developing process in order not to disorder the image developed by the yellow developing unit 6.

After transfer, the dielectric screen is positively charged by the transfer charger 25, and electrostatically adsorbs the transfer sheet. For performing the developing and transferring processes, a predetermined developing unit is selectively utilized for a required number of times according to color information and color designation required for an image to be formed.

Upon completion of the final transfer process, chargers 26, 27 are activated, and the chucking claw 38 is opened by the unillustrated cam to release the electrical and mechanical relations of the transfer sheet with the transfer drum 36 so that the transfer sheet is separated from the transfer drum 36 by a separation claw 28, and is then forwarded to a suctioning transport section 29. The separation charger 26 neutralizes and removes the electric charge of the dielectric screen by AC output and at the same time, acts to decrease the electrostatic adsorption forces of the dielectric screen and transfer sheet. The separation charger 26 and the charger 27 disposed opposite to each other with the dielectric screen therebetween neutralize and remove the electric charge on the surface of the transfer sheet by AC output when the transfer sheet is separated from the transfer drum 36. Consequently, electric discharge accompanied by the separating operation and dispersion of toner of the transferred image are prevented.

After separation, the transfer sheet is fixed by heat fixing roll in a fixing device 30, and then discharged onto a discharge tray 32 through a pair of paper discharge rollers 35. An image on the transfer sheet may be formed in any color image depending on the number of times of developing and transfer processes, and toner colors which are used for the developing process. Monochromatic image may also be obtained.

When a transfer sheet which has completed transfer process is separated from the transfer drum 36, a cleaning device 56 disposed on a side of the transfer drum 36 is pressed in contact with the transfer drum 36 by an unillustrated cleaner pressing solenoid to clean the transfer drum 36. After the transfer sheet is separated, the electric charge on the transfer drum 36 is removed by another action of the separation charger 26 to get ready for the next image forming process.

Figure 2:
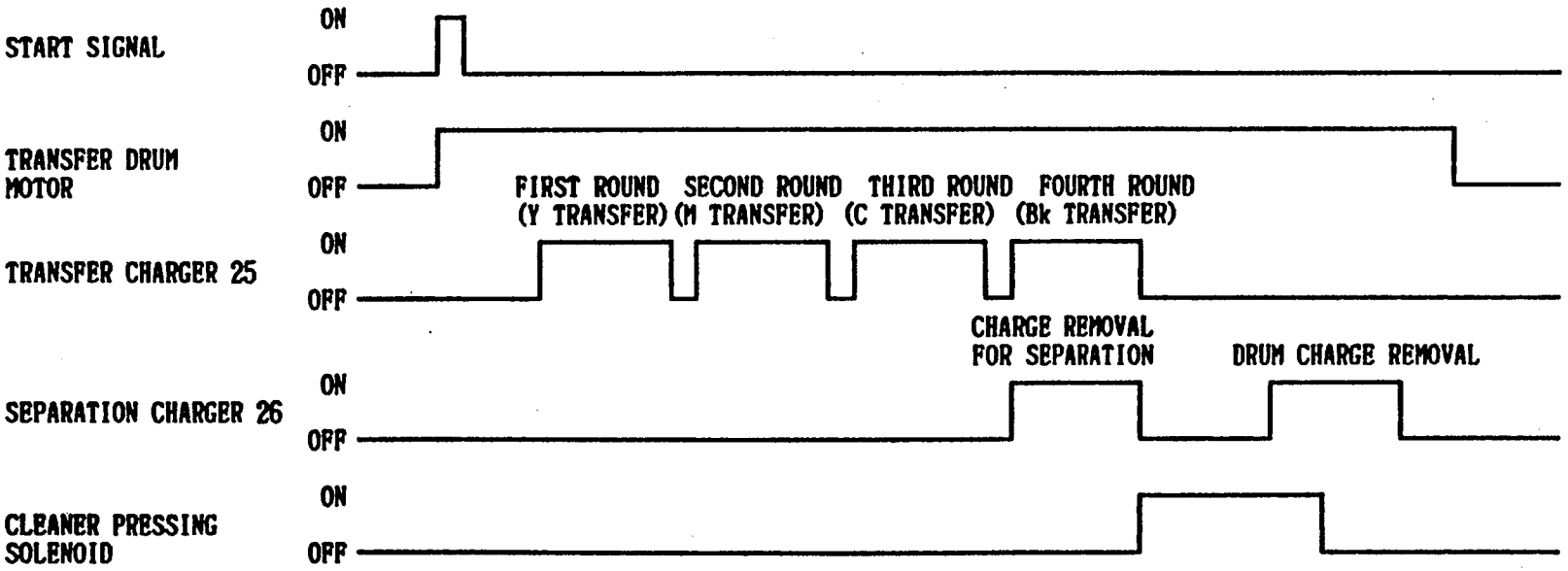
FIG. 2 is a time chart showing the main operation of the copying machine.

FIG. 2 is a time chart showing a main operation when a four-color composite image forming process is performed.

Now, a case is considered when a transfer process is repeated a plurality of times in an image forming operation. At a first round of transfer process, a predetermined electric current is supplied to the transfer charger 25. At this stage, the dielectric screen of the transfer drum 36 is charged with a predetermined electric charge by an output of the transfer charger 25, and a toner image on the photoconductive drum 1 is transferred onto a transfer sheet. The transfer charge charged on the dielectric screen at this time acts to weaken a transfer electric field for the next second round of transfer process. Therefore, when a second round of transfer process is performed, a transfer current is increased more than that of the first round of transfer process in order to compensate the transfer electric field. Thereafter, the transfer electric current is increased every time transfer process is repeated. The transfer efficiency on each round of transfer process can thus be improved.

An electric charge of the dielectric screen is risen by stages every time the transfer process is repeated. In order to obtain sufficient transfer efficiency, it is necessary to set an electric charge on each round of transfer process more than a fixed value. Even if a transfer output in each round of transfer process is set at a fixed value, it tends to increase the electric charge on the dielectric screen every time the transfer process is repeated.

If an output of the charger 26 is set at a fixed value, whereas an electric charge of the dielectric screen is increased in every round of transfer process, the electric charge required for separating a sheet is excessively or insufficiently removed. When a color image is formed by a four-color composite image forming process, for instance, if an output of the charger 26 is set corresponding to a charge to be charged on the dielectric screen after the completion of fourth color composite image forming process, the output exceeds a charge to be charged on the dielectric screen when an image is formed under three rounds of composite image forming process.

If the charge is removed excessively, an electrostatic adsorption force of toner to a transfer sheet is lowered. Accordingly, the toner of an image transferred onto a transfer sheet is affected by a mechanical shock when the transfer sheet runs into a pair of fixing rollers of the fixing device 30, by the electrostatic repulsive force generated by frictional charge between the fixing rollers, by the electrostatic repulsive force which is generated by frictional charge between the transfer sheet and the separation claw 28 which is provided for mechanically separating the transfer sheet from the dielectric screen and the like, and the toner is scattered to disorder an image.

Conversely, if an output is set corresponding to an electric charge to be charged on the dielectric screen after a first image transfer process, the output is insufficient for the charge to be charged on the dielectric screen when an image is formed by more than two rounds of composite image forming processes. If the charge is not removed sufficiently, an aerial discharge is increased when a transfer sheet is separated from the dielectric screen, and eventually, it becomes impossible to prevent the toner from dispersion. Further, when the charge is not removed sufficiently, electrostatic adsorption forces of a transfer sheet and the dielectric screen are strengthened to cause the separation claw 28 to forcibly separate the transfer sheet thereby increasing frictional charge between the transfer sheet and dielectric screen, and toner is scattered since it acts as electrostatic repulsive force to the toner. In order to solve such an inconvenience, the present embodiment is arranged to increase an output of the separation charger 26 corresponding to the number of times of transfer process when an image forming process is performed.

If electric resistance of a transfer sheet is high, when the transfer sheet is separated from the photoconductive drum 1 after the completion of a transfer process, the electrostatic capacity is decreased with an increase in distance between the drum and transfer sheet so that the electric charge on both of them are rapidly increased and causes to generate electric discharge partially, and eventually, a transferred image is disordered. Even if an ordinary sheet of paper is used as transfer sheet, electric resistance is risen when humidity is lowered. In the case when OHP paper is used as transfer sheet, the resistance is specially high and said electric discharge is easily occurred.

In order to deal with such problems, the present embodiment is arranged to increase an output of the transfer charger 25 corresponding to the humidity and the degree of resistance whether a transfer sheet is OHP sheet or not. Such an adjustment of transfer output affects an electric charge to be charged on the dielectric screen for transfer process, and it causes to remove electric charge excessively or insufficiently by the separation charger 26.

The present embodiment is, therefore, further arranged to adjust an output of the separation charger 26 corresponding to the humidity and transfer sheet whether it is an OHP sheet or not. The humidity is detected by a humidity sensor 57 shown in FIG. 1. The sensor 57 may preferably be disposed adjacent to the paper feed cassettes 19*a*, 19*b* as illustrated in FIG. 1 to detect a state of humidity based on a transfer sheet.

Figure 3:
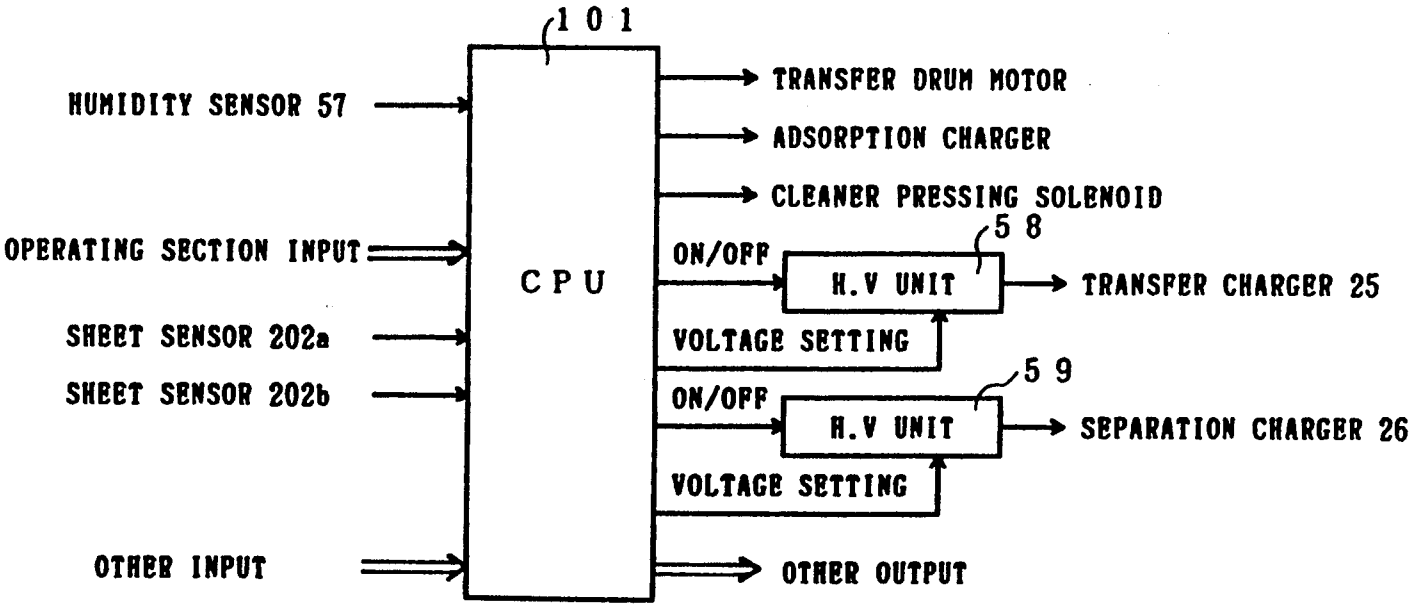
FIG. 3 is a schematic block diagram showing a control circuit of the copying machine.

In order to control the above-described operation, in the input side of CPU 101 which controls the main body in the control circuit shown in FIG. 3, such signals as a start signal for starting an image forming operation, an image forming mode signal for designating the number of times of transfer process, an operation signal from operating section for selecting the kind of transfer sheet and the like, a detecting signal from the sheet sensors 201*a*, 201*b*, and a detecting signal from the humidity sensor 57 are inputted.

In the output side, such signals as turning on-and-off signals of the transfer charger 25 and separation charger 26, and a voltage setting signal are output in addition to turning on-and-off signals of transfer drum driving motor, adsorption charger and the like. In FIG. 3, reference numerals 58 and 59 represent a boosting driving circuit of the transfer charger 25 and separation charger 26 respectively.

FIG. 2 shows an output timing of the transfer charger 25 and separation charger 26 in an image forming process.

Figure 4:
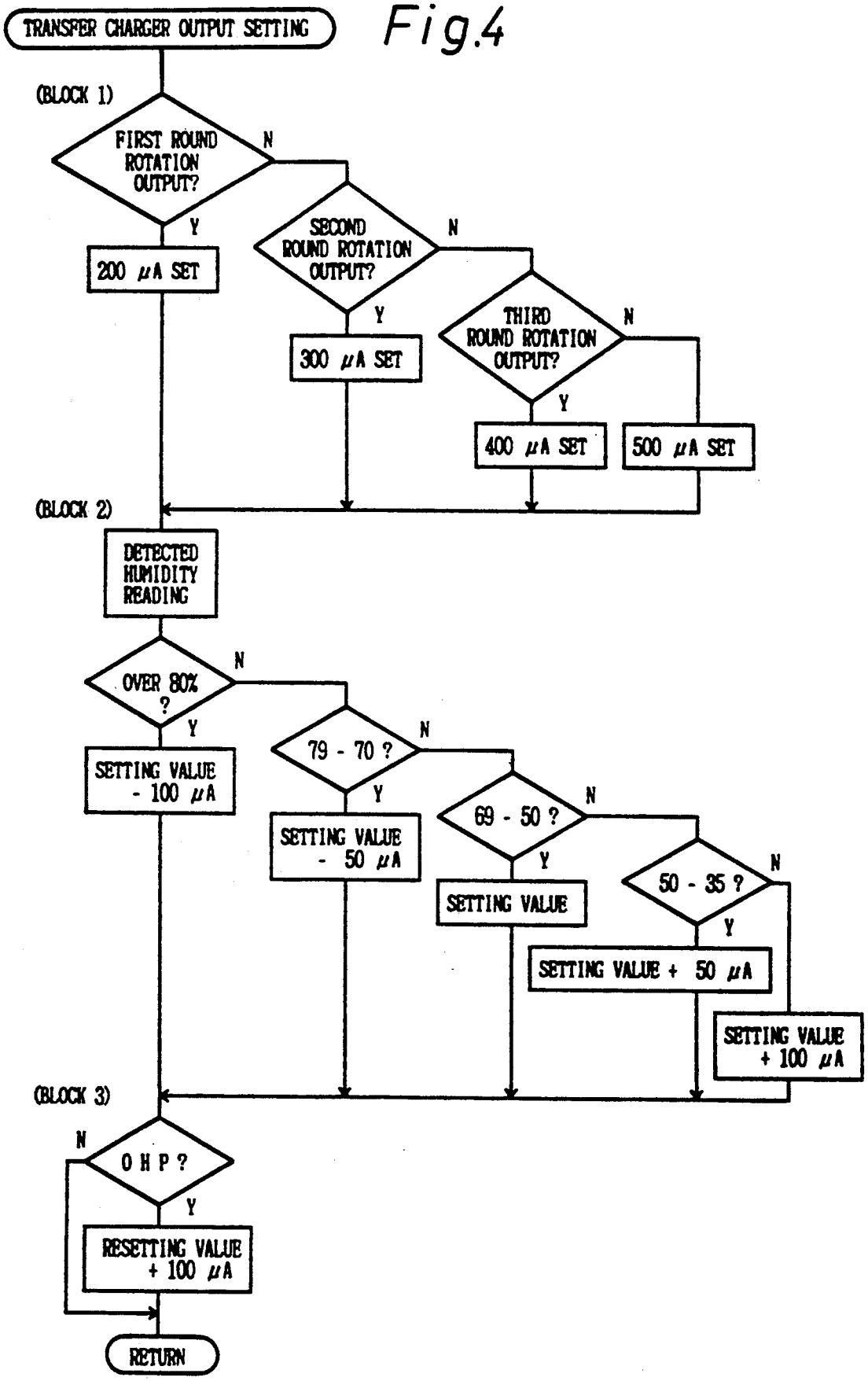
FIG. 4 is a flow chart showing a subroutine wherein an output of transfer charger is processed by the control circuit.

Description will now be made concretely on the output control of the transfer charger 25 and separation charger 26 referring to FIGS. 4 and 5 wherein FIG. 4 shows output setting process of the transfer charger 25.

In block 1, a judgment is made on the number of times the transfer process is performed by the number how many times the transfer drum 36 has actuated the standard position sensor 44 (FIG. 1) after the starting signal was turned on, and every time the number of times of the transfer process is increased from a first rotation to a fourth rotation, an output of the transfer charger is set to subsequently increase from 200 μA to 300 μA, 400 μA, and 500 μA thus fully accomplishing the transfer process at each stage without being affected by electric charge on the dielectric screen in the previous transfer process.

In block 2, a humidity information detected by the humidity sensor 57 is read, and the setting output of the transfer charger 25 is adjusted to −100 μA, −50 μA, setting value, +50 μA, and +100 μA depending on whether the humidity is over 80% or any one of 79–70%, 69–50%, 50–35%, below 34%. Transfer efficiency can thus be protected from being affected by the change in electric resistance of a transfer sheet caused by the humidity.

In block 3, the resetting output is further adjusted by +100 μA only when an OHP sheet is used as transfer sheet whereby transfer efficiency is protected from being affected by extremely high electric resistance of the OHP sheet.

Figure 5:
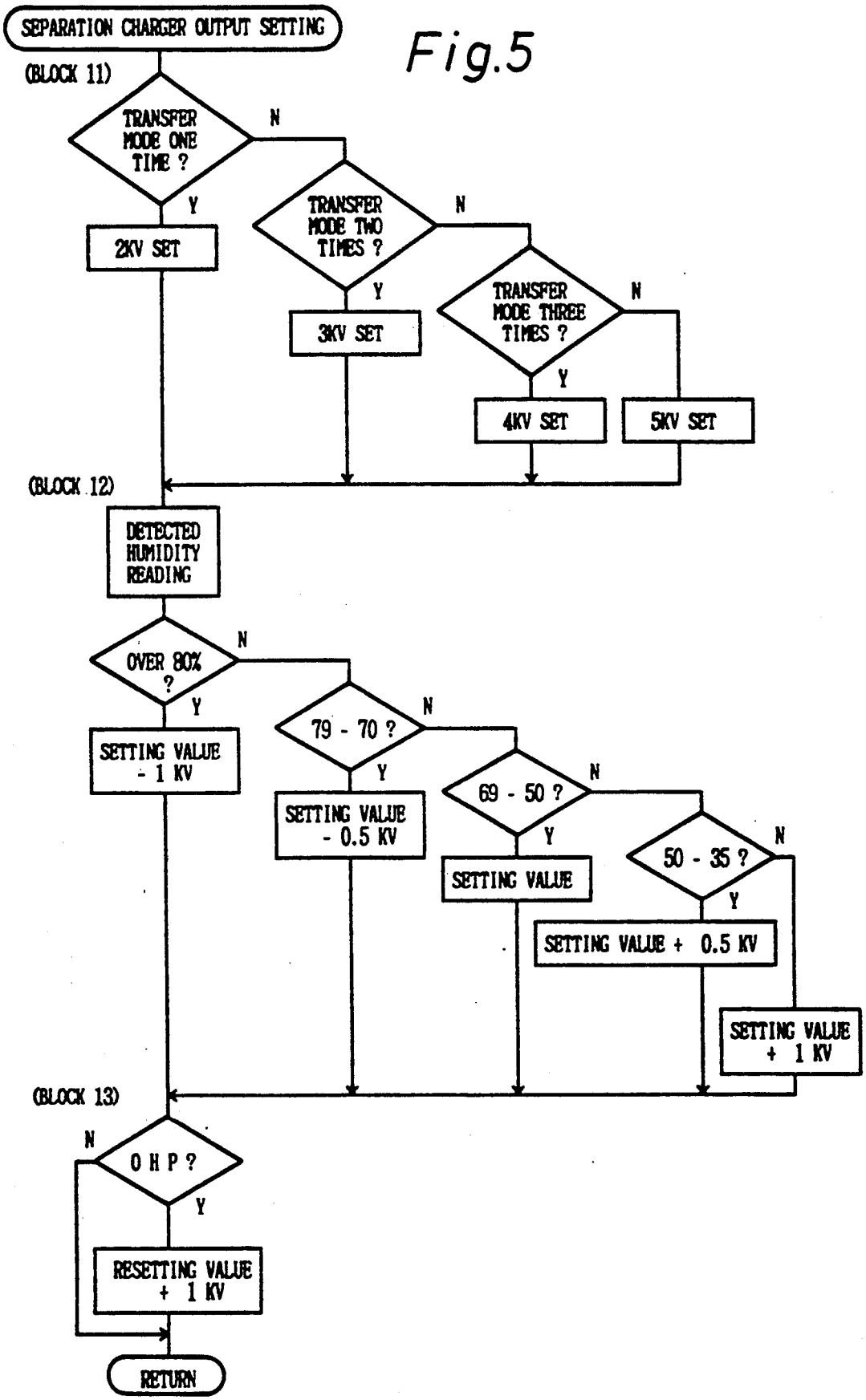
FIG. 5 is a flow chart showing a subroutine wherein an output of separation charger is processed by the control circuit.

FIG. 5 shows output setting process of the separation charger 26. In block 11, output of the separation chargers 26, 27 is set at 2 KV, 3 KG, 4 KV and 5 KG depending on what image forming mode is set, from one round of transfer process to four rounds of transfer process, so that sheet separating operation is protected from being affected by the increase of electric charge on the dielectric screen.

In block 12, the humidity information detected by the humidity sensor 57 is read, and the setting output of the separation charger 25 is adjusted to −1 KV, −0.5 KV, setting value, +0.5 KV and +1 KV depending on whether the humidity is over 80% or any of 79–70%, 69–50%, 50–35%, below 34% whereby the transfer output is varied corresponding to the humidity, and even if the electric charge on the dielectric screen is changed, the sheet separating operation is protected from being affected by the change of electric charge on the dielectric screen.

In block 13, the resetting output is further adjusted by +1 KV only when an OHP sheet is used as transfer sheet whereby transfer output is increased corresponding to the extremely high electric resistance of the OHP sheet, and sheet separating operation is not affected even if the electric charge on the dielectric screen is increased.

In the present embodiment, the output of only the separation charger 26 which is positioned opposite to the dielectric screen is adjusted corresponding to the number of times of transfer process in an image forming operation. However, in the case when the electric charge of a transfer sheet is increased corresponding to the number of transfer process like the case of the dielectric screen, output of the separation charger 27 may also preferably be adjusted.

In the present embodiment, output of the transfer charger is controlled so as to be increased corresponding to the number of transfer process. However, not limiting to this arrangement, the present invention may also be applied to an apparatus wherein the output of the transfer charger is not changed by the number of times of the transfer process, and the same operational effect as described above can be accomplished.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein

What is claimed is:

1. An image forming apparatus, comprising:

a photoconductor;

means for forming a toner image on the photoconductor;

an intermediate transfer member disposed opposite to the photoconductor for holding a sheet on its cicumferential surface;

a transfer charger disposed opposite to the photoconductor through the intermediate transfer member for transferring a toner image from the photoconductor onto a sheet held on the intermediate transfer member;

a separation charger disposed at a downstream side of the transfer charger in the rotational direction of the intermediate transfer member for separating the sheet from the intermediate transfer member;

means for recognizing the number of times the toner image is transferred; and means for setting an output of the separation charger corresponding to the number of times the toner image is transferred.

2. The image forming apparatus as defined in claim 1, wherein the setting means sets an output of the separation charger at an increasingly larger value as the number of times the toner image is transferred increases.

3. The image forming apparatus as defined in claim 1, further comprising:

means for detecting a state of surroundings; and means for correcting a value set by the setting means basing on an output received from a detecting means.

4. The image forming apparatus as defined in claim 1, further comprising:

means for judging king of sheet; and means for correcting a value set by the setting means corresponding t a result of the judgment.

5. The image forming apparatus as defined in claim 1, further comprising means for increasing an output of the transfer charger every time the toner image is transferred.

6. A method of forming an image on a sheet by electrostatically transferring a toner image formed on an image holding member onto a sheet held by a transfer member, comprising the steps of:

a) forming a toner image on the image holding member;

b) electrostatically transferring the toner image onto a sheet on the transfer member;

c) repeating steps a) and b) for a predetermined number of times for the same sheet; and d) removing electric charge on the transfer member by a charger, said charger output being varied based on the number of times steps a) and b) are repeated.

7. The method as defined in claim 6, wherein said output of the charger is varied over a larger range as the number of times steps a) and b) are repeated increases.

8. The method as defined in claim 7, further comprising the steps of:

detecting a state of surroundings; and correcting the output of the exchanger based on the state of surroundings.

9. A method of forming a colored image on a sheet by electrostatically transferring a colored toner image formed on an image holding member onto a sheet held by a transfer member, comprising the steps of:

a) forming a toner image on the image holding member by using a toner selected from yellow toner, magenta toner, cyan toner and black toner;

b) electrostatically transferring the toner image onto the sheet on the transfer member;

c) changing the color of the toner in step a);

d) repeating states a) and b) for a predetermined number of times with respect to the same sheet;

e) removing electric charge on the transfer member by a charger, said charger being varied based on the number of times steps a) and b) are repeated; and f) fixing the toner image onto the sheet after steps a)–e) are completed.

* * * * *